United States Patent [19]

Fish

[11] 4,318,354

[45] Mar. 9, 1982

[54] AUTOMATIC TELLER MACHINE

[75] Inventor: Leonard A. Fish, Chicago, Ill.

[73] Assignee: Avco Investment Management Corporation, Greenwich, Conn.

[21] Appl. No.: 966,581

[22] Filed: Feb. 5, 1979

[51] Int. Cl.[3] ..... E05G 1/04

[52] U.S. Cl. ..... 109/59; 292/38

[58] Field of Search ..... 109/58, 59, 64; 70/232; 292/38, 141, 171; 312/216

[56] References Cited

U.S. PATENT DOCUMENTS

| | | | |
|---|---|---|---|
| 997,795 | 7/1911 | Fish . | |
| 1,610,798 | 12/1926 | Kowalski . | |
| 2,238,266 | 4/1941 | Johnson | 292/38 X |
| 2,653,070 | 9/1953 | McClellan | 109/59 |
| 2,956,525 | 10/1960 | Blauvelt . | |
| 2,996,322 | 8/1961 | McClellan | 109/59 X |
| 3,748,879 | 7/1973 | Singer et al. | 70/232 |

FOREIGN PATENT DOCUMENTS

| | | | |
|---|---|---|---|
| 1267259 | 9/1962 | France | 292/38 |

*Primary Examiner*—David H. Corbin

*Attorney, Agent, or Firm*—Irwin P. Garfinkle; Robert J. McNair, Jr.

[57] ABSTRACT

A compact automatic teller machine has an elevator assembly, a plurality of bill dispensers are located on one side of the elevator assembly for dispensing bills of one or more denominations to said elevator assembly, whereby the bills are made available to an operator at the upper part of the elevator assembly. A steel back plate assembly is provided with slides for supporting a front cover for sliding relationship relative to the back plate, and steel plates making up the back plate assembly, and the cover, define two separate secure compartments, for the bill dispensers and for a deposit box. Access to the sides of both secure compartments is permitted when the cover is opened. Multiple locking means is provided for locking the cover in closed relationship to the back plate. The locking means incorporates a plug lock for normally preventing access to a crank socket, a combination lock, for normally locking a shaft against rotation by crank, a breakable connection between the crank socket and the shaft, and a drum adapted to be turned by the shaft to adjust the position of a plurality of cables connected to spring-biased bell cranks which control movement of a plurality of latch bars slideably mounted on the back plate and adapted to engage flanges on the cover.

8 Claims, 8 Drawing Figures

FIG 1
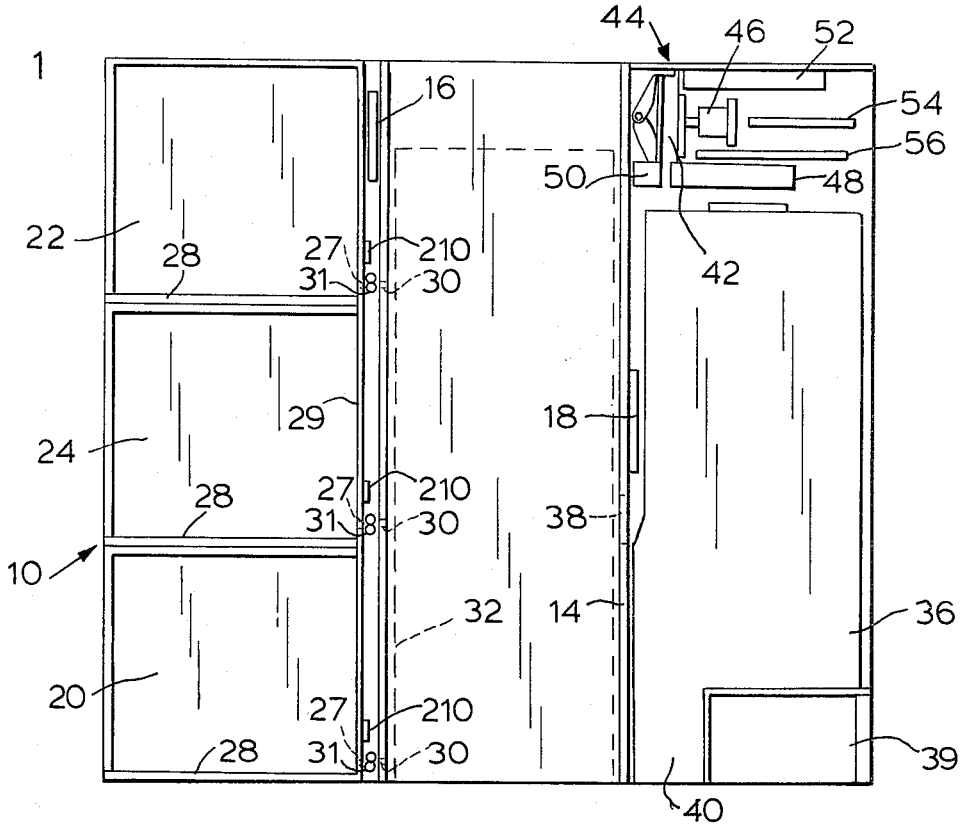
FIG 2
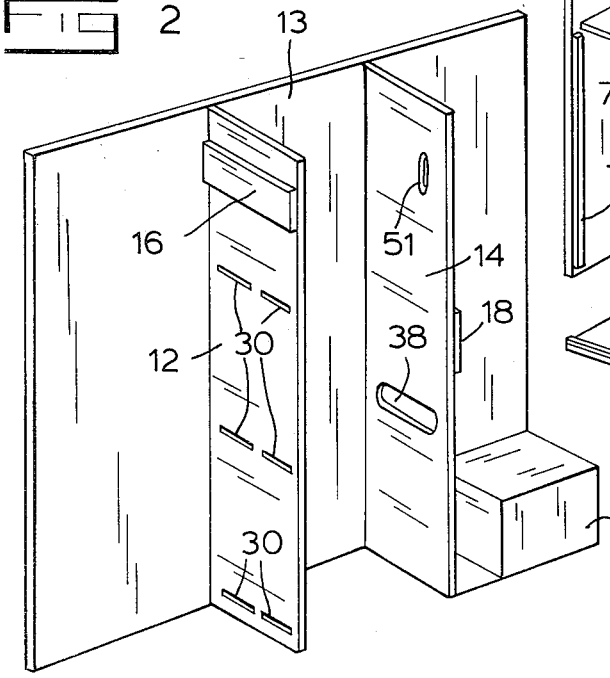
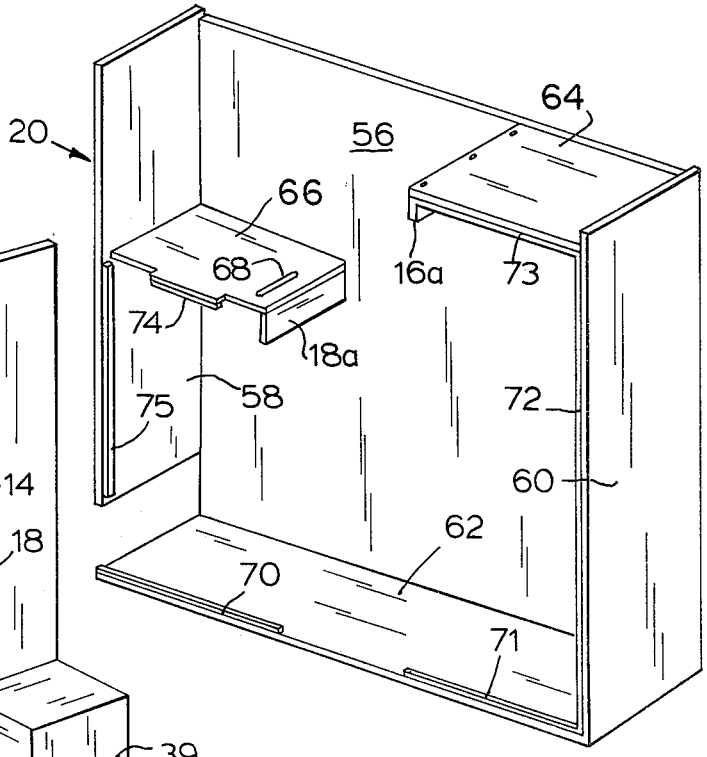
FIG 3

AUTOMATIC TELLER MACHINE

BACKGROUND OF THE INVENTION

1. Field of the Invention

The present invention relates to automatic teller machines, and more particularly to such machines which are capable of receiving deposits, and dispensing a number of bills of different denominations along with a receipt therefor.

2. The Prior Art

Recently it has become feasible to employ automatic teller machines for performing many of the functions customarily performed by bank tellers and the like. The automatic teller machines must have the capability of accepting deposits, and/or dispensing money when appropriately controlled. In conventional machines, money can be dispensed only in one or two denominations. This represents a severe limitation on the flexibility of use of the machine, since it is frequently desirable to have different amounts of money dispensed from the machine. For example, it would be desirable to permit the dispensing of any selected number of bills in up to six different dollar denominations, as may be desired by the customer.

Another disadvantage of conventional automatic teller machines is that they tend to be extremely large and bulky. In part, the size and bulkiness of previous machines is dictated by the mechanism by which the money is dispensed. It is desirable to provide a machine which, without sacrificing any security, allows the use of locked dispensing modules which are considerably smaller and lighter, and which also allows a compact and efficient arrangement for all of the other parts of the machine.

In previous automatic teller machines, it is generally required to have two people service or maintain the machine together, to safeguard the money which is contained in the machine, and it is necessary to have a double check system for any operations involving access to the interior of the machine. It is accordingly desirable to provide an arrangement which allows the machine to be serviced and maintained by a single person, and the dispensers and deposit box replaced, without compromising the security of the machine. Such service and maintenance includes replacing the dispensers with fresh, full units and replacing the deposit box with a fresh, empty unit, as well as any repair or mechanical maintenance operations.

It is also a requirement in conventional automatic teller machines, for security reasons, that a secure locking arrangement be provided. Typically, in conventional automatic teller machines, this has necessitated a relatively large and bulky locking arrangement. It is accordingly desirable to provide a locking arrangement which, without sacrificing security, fits within a minimum of space, and allows easy access to the interior of the automatic teller machine for service and maintenance.

SUMMARY OF THE INVENTION

It is a principal object of the present invention to provide a small and compact automatic teller machine, which allows easy access to its interior for service and maintenance, without compromising the security of the apparatus.

It is another object of the present invention to provide such an automatic teller machine with a multiple locking mechanism arranged in such a way as to defeat the most determined attempts to break into the machine within a reasonable period of time.

Another object of the present invention is to provide an automatic teller machine with a means for allowing easy access to the interior of the machine, with locking means for locking a removable cover into fixed position in relation to a back plate by a plurality of locking bars and with means for insuring that the machine cannot be opened by breaking into any small part of the machine.

Another object of the present invention is to provide an arrangement for an automatic teller machine which is capable of dispensing a selected number of bills in any of a plurality of denominations.

A further object of the present invention is to provide an automatic teller machine which provides access to a plurality of individually dispensed bills at a single location, together with a transaction receipt.

Another object of the present invention is to provide an automatic teller machine having a collector assembly for collecting bills dispensed from a plurality of bill dispenser mechanisms, and making the collected bills available at a single location to which a user has access.

Another object of the present invention is to provide positive transfer means for transferring dispensed bills from a plurality of individual bill dispensers to a collector assembly.

A further object of the present invention is to provide an automatic teller machine with individual receiving means for receiving a plurality of individual bill dispensers, and coded means for orienting and controlling the positions of bill dispensers.

A further object of the present invention is to provide an automatic teller machine having a removable deposit box for receiving deposits and for receiving dispensed bills which, although dispensed, are not withdrawn by an operator.

A further object of the present invention is to provide means for identifying when a bill is being dispensed from one of the dispensing mechanisms to the collector assembly.

In one embodiment of the present invention, an automatic teller machine is provided having a back plate assembly with a slide mounted thereon for supporting a front cover for horizontal sliding movement away from the back plate, to expose locations for receiving a plurality of individual bill dispensers and a deposit box. A multiple lock device locks the cover securely to the back plate when it is in its closed position. The multiple lock incorporates a combination lock for selectively preventing rotation of the shaft, a plug lock for selectively providing access to a crank socket for turning the shaft, a drum rotated by the shaft for controlling the position of a plurality of cables, a plurality of latch bars, and a plurality of spring-biased bell cranks connected to the cables and regulating movement of the latch bars. The machine has a plurality of compartments for receiving individual bill dispensers, with coded means for orienting and controlling the location of the various dispensers.

A collector assembly in the form of an elevator is juxtaposed with the dispensers and positive feed rollers are interposed between the dispensers and the collecting elevator. The elevator is adapted to receive bills dispensed from the dispensers at a plurality of elevations, and to present the collected bills to an access compartment which is accessible to an operator.

BRIEF DESCRIPTION OF THE DRAWINGS

Reference will now be made to the accompanying drawings in which:

FIG. 1 is a diagrammatic illustration of the front view of an automatic teller machine incorporating an illustrative embodiment of the present invention, illustrating the relative position of the various parts of the machine;

FIG. 2 is a perspective view of the back plate assembly of an automatic teller machine incorporating the present invention;

FIG. 3 is a perspective view of the front cover of an automatic teller machine incorporating the present invention;

DESCRIPTION OF THE PREFERRED EMBODIMENT

Figure 5:
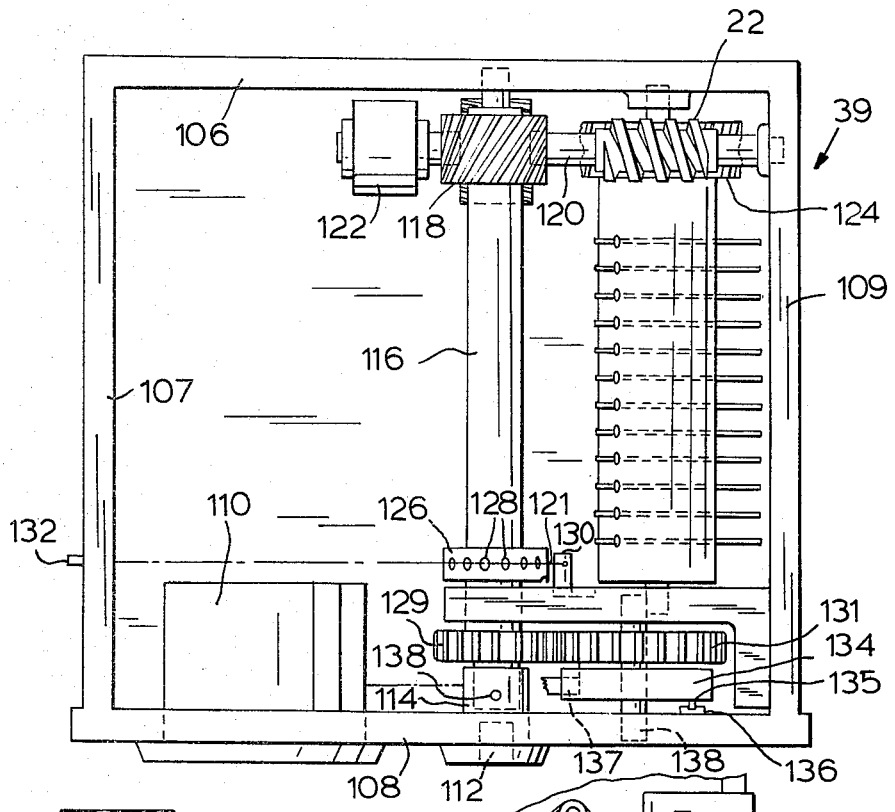
FIG. 5 is a plan view of the locking assembly associated with the apparatus of FIG. 4.

Referring first to FIG. 1, a front elevational view of an automatic teller machine 10 incorporating the present invention is illustrated. The machine 10 incorporates a pair of spaced-apart parallel walls 12 and 14 which are mounted on and fixed to a back plate (FIG. 2) and which support a pair of slides 16 and 18. The cover assembly 20 (FIG. 3) is supported on the slides 16 and 18 so that it can be pulled outwardly from the back plate assembly to expose the interior of the automatic teller machine for service and maintenance.

The walls 12 and 14, together with the back plate 13, and the plates forming the cover assembly 20, are constructed of high-strength material such as steel, with considerable thickness, to resist and repel the most determined attempt to break into the machine. When the cover assembly is in a closed position relative to the back plate, two separate compartments are completely surrounded with plate material, and those portions respectively contain the bill dispensing modules and the deposit box.

In the automatic teller machine illustrated in FIG. 1, six bill dispensing modules are provided, three of which are illustrated. The modules 22, 24 and 26 are illustrated, and three additional modules are located directly behind them, so that they cannot be seen in FIG. 1. Each of the dispensing modules is constructed in accordance with the apparatus disclosed and claimed in the copending Fish application Ser. No. 786,760, filed Apr. 12, 1977, for "Single-Bill Currency Dispenser", now abandoned, the disclosure of which is incorporated hereinto by reference.

The dispensing modules are received in a casing having a shelf 28 for each module, and a rear wall 29. An aperture 27 in the wall 29, and an aperture 30 in the wall 12 are aligned with the opening in each of the dispensing modules, through which the bills are dispensed. A power feed roller 31 is located between the walls 29 and 12, as viewed in FIG. 1, for positively feeding the dispensed bills from the dispensing modules into the collecting area illustrated diagrammatically in FIG. 1 by the dashed rectangle 32. The collecting assembly comprises an elevator mechanism disclosed and claimed in the copending application Fish application for "Elevator Mechanism for Automatic Teller Machine" filed contemporaneously herewith, the disclosure of which is incorporated hereinto by reference. The elevator mechanism functions to raise a flat tray past the various sets of feed rollers 31, collecting all of the bills which are dispensed therethrough, and makes the collected bills available at the upper portion of the machine at an access compartment 34. In operation, bills are dispensed through the feed rollers 31 provided for each of the dispensing units, and are collected by the elevator and raised to the top of the machine. A hinged cover (not shown) automatically opens when the elevator reaches its upper position, so that an operator may reach into the area 34 and withdraw the bills which have been dispensed. In case any bills are not withdrawn by an operator, they are fed into an escrow compartment of the deposit box 36 through an aperture 38, by a mechanism which is described and claimed in the aforementioned Fish application.

The deposit box 36 is located in the space to the right of the wall 14, and incorporates an escrow compartment for receiving the bills fed through the aperture 38, as the elevator mechanism returns to its lower position. The construction and operation of the deposit box 36, together with its escrow compartment, is described and claimed in a Fish application for "Deposit Box", filed contemporaneously herewith, the disclosure of which is incorporated hereinto by reference. A lock assembly 39 is located directly under the deposit box 36 and is described in more detail hereinafter. A compartment 40 located beside the lock mechanism 39 contains motors which are required for operating the elevator mechanism 32 and for driving the feed rollers 31. The driving connection with the feed rollers 31 is by a belt drive, with the belt passing over a pulley fixed to the shaft of each of the feed rollers 31. Since the drive arrangement for the feed rollers 31 forms no part of the present invention, it will not be described in detail herein. A conventional chain drive is also used to raise and lower the elevator tray.

Above the deposit box 36, an envelope chute 42 is shown in cross section. The lower end of the envelope chute 42 is juxtaposed with a normally opened door in the upper portion of the deposit box 36. Above the chute 42, an envelope stamp mechanism 46 is disposed. Both the envelope receiving mechanism 44 and the stamp 46 are disclosed in more detail hereinafter. Disposed below the stamp mechanism 46 and forwardly of the chute 42, is a receipt printer 48, and an electrically operated shears 50 is disposed between the receipt printer 48 and an aperture 51 in the wall 14. The receipt printer 48 is adapted to print a paper transaction receipt, and advance it through an aperture 51, so that it can fall onto the top of the elevator tray, after being severed by the shears 50. In this way, the receipt is made available to the operator together with the bills which are collected at the access compartment 34.

A display unit 52 is located at the upper portion of the right side of the machine, and provides a display of instructions for the operator as to how to operate the machine.

A plurality of printed circuit boards 54 and 56 are disposed beneath the display unit 52, for supporting the electronic components required for the control operations of the automatic teller machine.

Referring to FIG. 2, a perspective view of the back plate 13 of the unit is illustrated. The back plate 13 supports the walls 12 and 14, which in turn support the slides 16 and 18. In addition, the back plate supports the lock assembly 39, which is surrounded by thick steel walls. The back plate assembly is designed to be supported on a vertical surface such as a wall by having the back plate 13 firmly secured to the wall by bolts or the like, so that it becomes an integral part of the building it is in.

The cover assembly 20 is illustrated in FIG. 3 and comprises a front plate 56, two side plates 58 and 60, and a bottom plate 62. The side plate 60 extends for the whole height of the unit, while the side plate 58 extends downwardly only to the top of the lock unit 39. The wall 58 need not extend below the lock unit because the lock unit is secure in itself, and must be accessible from outside. The top wall 64 covers the area overlying the dispensing modules 22, 24 and 26, and supports a slide unit 16*a* which cooperates with the slide 16 illustrated in FIG. 1.

A stop wall 66 overlies the deposit box 36, and is provided with a slot 68 which is aligned with the envelope chute 42, to allow envelopes to fall into the deposit box 36. The wall 66 supports a slide 18*a* which cooperates with the slide 18 illustrated in FIG. 1. The slides 16, 16*a*, 18 and 18*a* are heavy duty drawer slides of conventional construction, and allow the cover assembly to be pulled forward while still supported by the back plate assembly.

A plurality of flanges 70–75 are disposed at the rear periphery of the walls 62, 60, 64, 66 and 58, respectively, and are adapted to cooperate with locking bars mounted on the rear plate 13. Preferably, six locking bars are provided, one for each of the flanges 70–75, and it can be seen that when the cover of FIG. 3 is in closed position in relation to the apparatus of FIG. 2, two separate compartments of the automatic teller machine are completely enclosed and secure, surrounded by the thick plate material. One is the protected compartment containing the dispensing modules, which is enclosed by walls 13, 12, 60 and 56. The other is the compartment containing the deposit box defined by the walls 13, 14, 56 and 58. In addition, the lower wall 62 and the upper walls 66 and 64 completely enclose the upper and lower portions of these compartments. In the open position of the cover, the dispensing modules and deposit box are accessible for replacement. Each may be locked in position by independent locking means (not shown), if desired.

Figure 4:
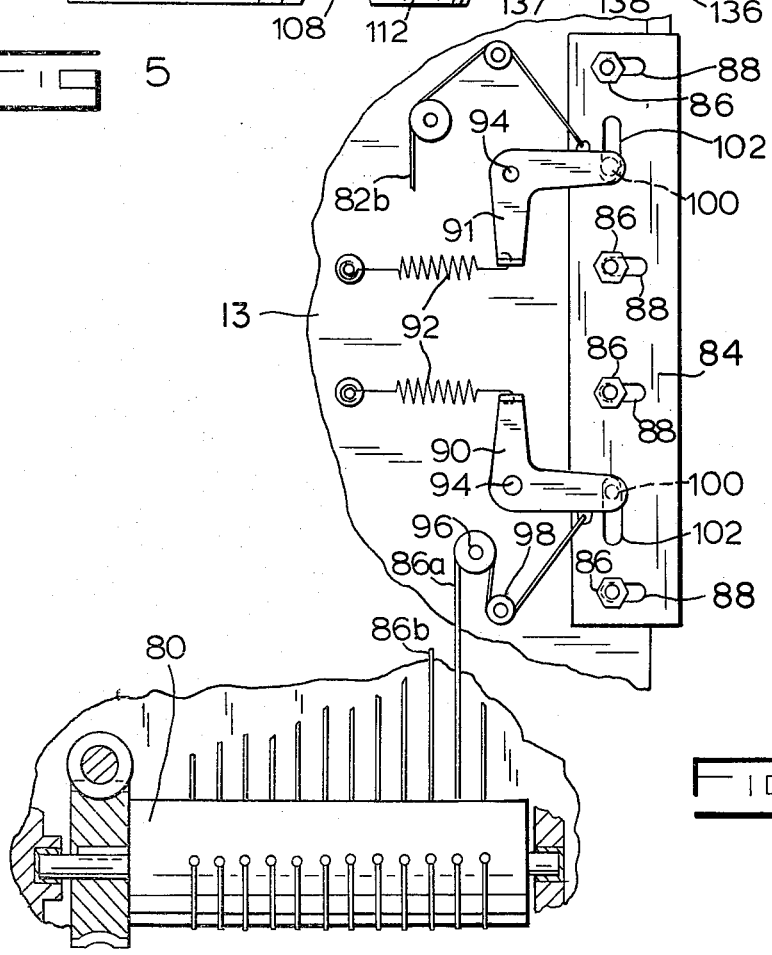
FIG. 4 is a diagrammatic view of a portion of the locking assembly of an automatic teller machine incorporating the present invention.

Referring to FIG. 4, the lock arrangement for the automatic teller machine of the present invention is illustrated in diagrammatic form. A drum 80 is provided for controlling the degree of extension of a plurality of cables 82. One end of each of the cables 82 is fixed to the drum, and as the drum rotates, all of the cables are pulled in a direction toward the drum, when it is desired to unlock the cover from the back plate. In FIG. 4 only one locking bar 84 is illustrated, for simplicity. The locking bar 84 is supported on the back plate 13 by means of bolts 86, which extend through slots 88 in the locking bar 84. The locking bar 84 is adapted to move leftwardly from locked to unlocked position, sliding relative to the bolts 86.

The leftward movement of the locking bar 84 is controlled by a pair of bell cranks 90 and 91, each of which is provided with a spring 92 to bias it toward the closed position. The bell cranks are both mounted for rotation about individual shafts 94 supported by the back plate 13. The lower bell crank 90 is urged in a counterclockwise direction by its spring 92, but is prevented from rotating beyond the position illustrated in FIG. 4 by a cable 82*a*, extending from the drum 80 around a pair of pulleys 96 and 98. The pulleys 96 and 98 are both mounted on the back plate 13, and the drum itself 80 is supported very close to the back plate 13, so that a minimum of space forwardly of the back plate is required by the pulley and cable relationship.

When the drum 80 is turned, so as to shorten the cable 82*a*, the bell crank 90 is caused to rotate in a clockwise direction. A stud 100 is secured to the horizontal arm of the bell crank 90, and is received in the slot 102 of the locking bar 84. When the bell crank 90 rotates in a clockwise direction, the stud 100 bears against the slot 102 and forces the locking bar 84 leftwardly. Simultaneously, another cable 82*b* causes the bell crank 91 to rotate in a counterclockwise direction, and a corresponding stud and slot arrangement forces the upper portion of the locking bar 84 to the left.

Both of the bell cranks 90 and 91 must be rotated in order to cause the locking bar 84 to be moved away from blocking relationship with a flange secured to the cover assembly. If only one of the bell cranks is rotated, the other bell crank maintains the other end of the locking bar in its outward position, and prevents any inward movement of either end of the bar.

It is also apparent from FIG. 4, that the position of the bell cranks 90 and 91 in locked arrangement (as shown in FIG. 4) is such that the stud 100 is not quite engaged by the inner end of the slot 102. If the cable 82*a* were cut, in an attempt to break into the automatic teller machine, the spring 92 would rotate the bell crank 90 in a counterclockwise direction by an additional angle, bringing the stud 100 into engagement with the end of the slot 102. Since this is an over-center condition, force applied to the locking bar 84 serves only to press the stud 100 more tightly into engagement with the end of the slot 102, and does not result in any inward movement of the locking bar 84. If desired, the length of the cable 82*a* can be adjusted so that the normal locked position of the bell cranks 90 and 91 is in the over-center position.

The locking arrangement of FIG. 4 is very effective in maintaining a locked relationship between the cover and the back plate, employing only a minimum of space forwardly of the back plate. Accordingly, the locking arrangement, with the exception of the drum 80 and the means of locking it, takes up only a minimum space within the machine.

Referring now to FIG. 5, a plan view of the lock mechanism 39 is illustrated. The upper cover of the lock mechanism is shown removed. The lock unit 39 is defined by four vertical side walls 106–109, preferably bolted together, and a combination lock 110 is disposed in the wall 108. A plug lock 112 is also disposed in the wall 108. The plug lock 112 takes a form of a plug equipped with a key lock, so that the plug may be removed when a suitable key unlocks the lock. When the plug 112 is removed, a socket in a shaft 114 is exposed, and the end of a crank may be inserted into the socket through the aperture formerly occupied by the plug.

When the crank is inserted in the socket, the shaft 116 can be rotated, which rotates a gear 118 forming part of a right angle drive. The gear 118 causes a shaft 120 to rotate, which shaft is supported at one end by a bushing in the wall 109 and by pillow block 122 at its other end. The shaft 120 has a worm gear 122 which engages a gear 124 which is secured to the drum 80. Accordingly, rotation of the shaft 116 causes the drum 80 to rotate. The mechanical advantage is such that several rotations of the shaft 116 are required to give a partial revolution of the drum 80, and as only a partial revolution of the drum 80 is required to unlock the lock bar 84, this amount of movement is sufficient. The mechanical advantage of the gears 118, 122 and 124 makes it impossible to rotate the drum 80 by hand, if this were attempted by someone trying to break into the machine.

A collar 126 is fixed to the shaft 116 and rotates therewith. A plurality of holes 128 are provided around the periphery of the collar, and a pin 121 is mounted on a slide member 130 which is urged leftwardly by spring (not shown) so that the pin normally enters one of the holes 128 of the collar 126. A link 132 extends forwardly through the wall 107, supported by an aperture therein, and causes the pin to withdraw from the holes when the cover assembly is in place. The link 132 is breakable and passes behind the combination lock 110, so that if the lock 110 is pushed into the machine, the pin 121 reenters one of the apertures 128, relocking the machine.

A gear 129 on the shaft 116 meshes with a gear 131 rotatable on a shaft 138. A wheel 134 is fixed to the gear 131, and carries a pin 135 which cooperates with a stop member 136, which limits rotation of the wheel 134 in both directions, at the open position and at the locked position, respectively. A link 137 enters a notch in the wheel only when it is in its locked position. The link 137 prevents the combination lock 110 from turning unless the wheel 134 is in its locked position. This allows verification of the locked position from outside the machine.

The shaft 114, which contains the shaft socket, has a pin 138 which connects the shaft 114 to the shaft 116. The pin 138 is a shear pin so that when the shaft 114 is turned by the crank, the pin breaks if the shaft 116 is blocked either by the collar 126, or by the wheel 134, and the crank cannot thereafter turn the shaft 116. This insures that any attempt to turn the drum by means of the plug lock and the crank will not succeed unless the combination lock is operated and the cover is closed.

Figure 6:
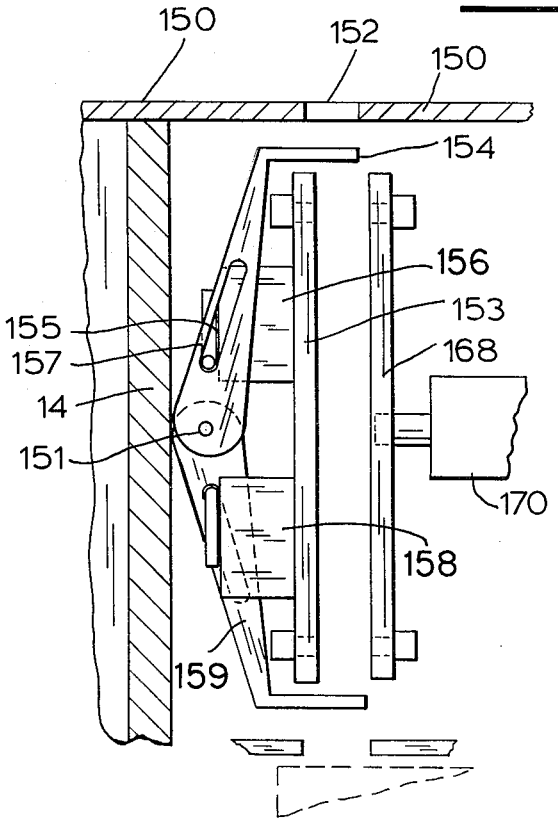
FIG. 6 is a front elevational view of a portion of the deposit receiving assembly of an automatic teller machine incorporating the present invention.

Referring now to FIG. 6, an arrangement for allowing an envelope to be inserted into the deposit chute 42 is illustrated. The top cover 150 is illustrated in FIG. 6, and it is shown with a slot 152 through which an envelope may be deposited. The slot is blocked in the position illustrated in FIG. 6, however, by an upper gate 154, which prevents an envelope from being inserted in the chute 42. The lower end of the U-shaped gate 154 is pivoted on a shaft 151 supported by a bracket (not shown) secured to the rear wall 153 of the chute. A rotary solenoid 156 is also mounted on the wall and has a tang 155 which is received in an angled slot 157 in one of the legs of the U-shape. A lower gate 159 is similarly arranged, and controlled by a solenoid 158. The solenoids 156 and 158 are energized one at a time. As the gate 154 is moved leftwardly, a path is cleared for the downward falling of an envelope through the slot 152 to the level of the lower gate 159. Then the upper gate closes, and the lower gate opens, allowing the deposit envelope to reach the deposit box 36.

Near the top of the gate 154, a light source 160 cooperates with a photocell 162, and a corresponding pair is located near the bottom end of the unit 154, where a light source 164 cooperates with a photocell 166. The light sources 160 and 164 are both mounted on the wall 153, aligned with an aperture therein, so that the beam of light can shine rightwardly and be received by the respective photocells 162 and 166 which are mounted on a bracket member 168. An envelope stamp mechanism 170 is mounted on a bracket 172, in position to stamp an envelope against the wall 153. With the arrangement illustrated in FIG. 6, the two light beams can be used to trigger the operation of the stamp mechanism twice. The stamp mechanism 170 is of a conventional type which causes its stamping number to be advanced after every second stamping. In the operation of the present invention, it is operated to stamp each envelope twice, with the same number, after which the number is advanced, so that the next envelope can be stamped with the next number. In this way each envelope which is received in the deposit box 36 can be identified and collated with the transaction record generated by the apparatus.

In a preferred mode of operation, the stamp mechanism 170 is first triggered when the bottom edge of the envelope intercepts the light beam between the light source 164 and the photocell 166. At this time the solenoid 156 is energized to withdraw the upper part of the unit 154 to allow the envelope to fall through the slot 152 so as to interrupt the lower light beam. When the first stamping has been effected, the solenoid 158 is energized, permitting the envelope to fall toward the chute 42. When the upper light beam established by the units 160 and 162 is no longer interrupted, the stamp 170 is triggered again to stamp the envelope a second time. Afterwards, when both light beams are cleared, the solenoid 156 is deenergized to close the lower portion of the envelope receiving slot. The solenoid 156 is energized to open the upper end of the gate 154 after the operator has entered a suitable account number and/or personal identification number, in conventional fashion. The double stamping of the envelope insures that the stamp number is readable in at least one stamp position, even though it may be secured or partially secured in one of two stamp positions.

It can be appreciated that the envelope stamp mechanism is sufficiently small and compact that it may be located in the space 44 illustrated in FIG. 1, directly above the chute 42. It is preferably disposed rearwardly behind the receipt printer 48 and its electrically operated shears 50, so that the receipt printer and shears do not interfere with the deposit of an envelope.

Figure 7:
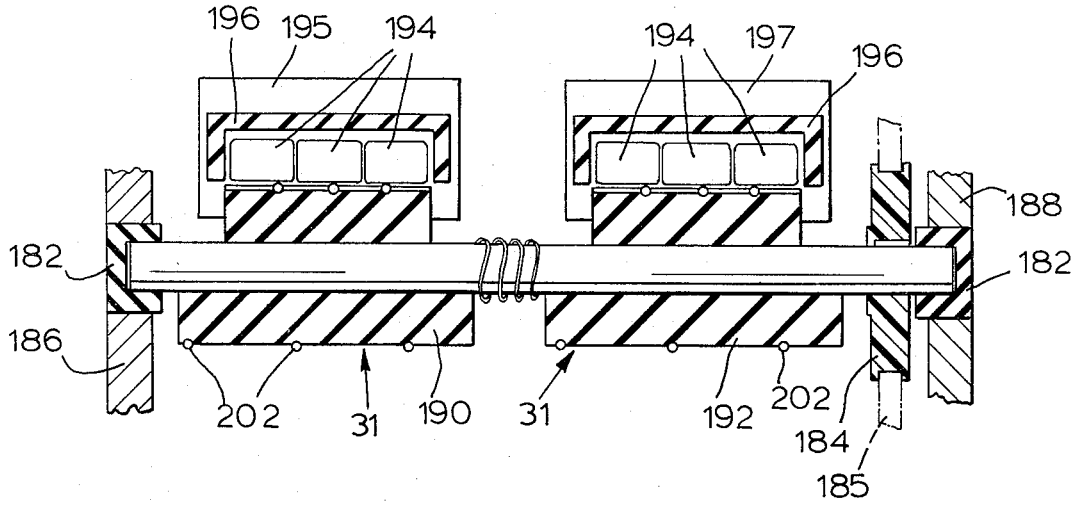
FIG. 7 is a vertical elevational view, partly in cross section, of a pair of positive drive rollers of an automatic teller machine incorporating the present invention, together with sensing means for sensing a bill in driven position in relation to the drive rollers.

Referring to FIG. 7, a pair of side-by-side power feed rolls 31 are illustrated, as shown diagrammatically in FIG. 1. The feed rolls 31 are mounted on a single shaft 180, which is supported at both of its ends by an insulating bearing 182. One end of the shaft 180 is connected to a pulley 184, which is in engagement with a belt 185 which is driven by a motor in the compartment 40 (FIG. 1). The belt 185 is formed of insulating material so that the shaft 180 is in electrical isolation relative to the metal parts of the frame of the machine. The insulating bearing members 182 are both mounted in brackets 186 and 188, respectively, attached to the wall 12. A soft rubber sleeve 190 is secured to the left end portion of the shaft 180, and a corresponding soft rubber sleeve 192 secured to the right hand portion. Above the sleeves 190 and 192, metallic rollers 194 are trapped in cages 196, formed of insulating material, and rest on the upper surfaces of the sleeves 190 and 192. The rollers 194 also bear on electrical contacts 195 and 197 mounted on the wall 12 and preferably supported by a printed circuit board or the like.

The nip between the sleeve 190 and the roller 194 is aligned with the exit aperture of one of the dispensing modules, so that a bill dispensed from that module is received and positively fed into the elevator assembly as the sleeve 190 is rotated by the shaft 180. The nip between the sleeve 192 and the roller bearing 196 is disposed in alignment with the exit aperture of the adjacent dispensing module, so that bills dispensed from that module are positively fed into the elevator assembly by rotation of the sleeve 192.

A conductive wire 202 has one end wrapped around one end of the shaft 180, and is in the form of a continuous helix, wound about the periphery of the sleeve 190, the central portion of the shaft 180, the sleeve 192, and finally about the other end of the shaft 180. The wire 202 sinks into the surface of the sleeves 190 and 192, so that it does not interfere with the gripping and driving contact that the sleeves 190 and 192 make with bills which are being dispensed. They remain sufficiently on the surface, however, to make an electrical contact with the rollers 194 and 196, such that when no bill is in feeding position, relative to the sleeves 190 and 192, there is a complete electrical circuit between the roller 194, through the wire 202, to the roller 196. The contacts 195 and 197 touch the surface of the rollers 194, and form terminals which may be connected to sensing apparatus for sensing the presence or absence of a bill being dispensed.

In operation, when one of the dispensing modules is directed to dispense a bill, the bill, when dispensed, is received in the nip between one of the sleeves 190 and 192 and its respective rollers, and interrupts the electrical circuit between the contacts 195 and 197. When feeding of the bill is complete, the electrical contact between the contacts 195 and 197 is restored, so that the dispensing operation can be recognized as completed. This sensing mechanism is simple and completely effective to indicate when no bill is being fed. Accordingly, the controlling apparatus of the automatic teller machine can respond properly to operation of the dispensing mechanism. The sleeves 190 and 192 may be made of a conductive elastomer, if desired, in which case the wire 202 is not required.

Figure 8:
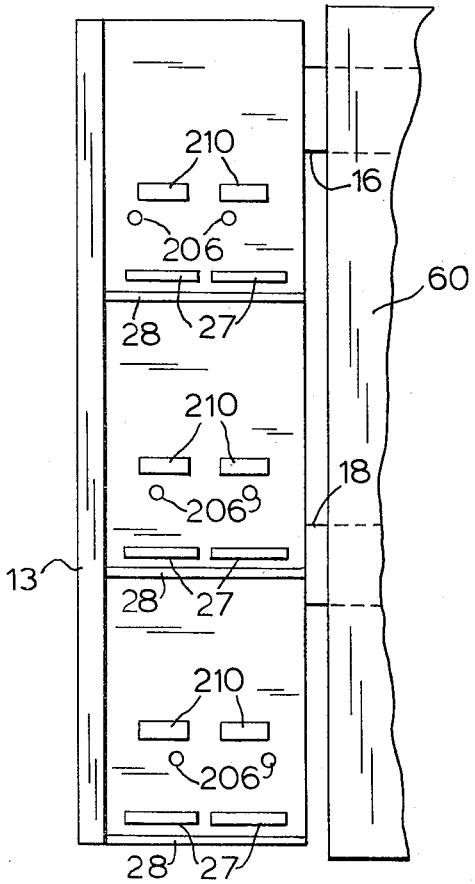
FIG. 8 is a side view of the left side of the apparatus of FIG. 1.

Referring to FIG. 8, a side view of the left side of the apparatus of FIG. 1 is illustrated, with the cover assembly drawn back on the slide 16 and 18 to expose the compartments for receiving the dispensing modules such as the modules 22, 24 and 26. The apertures 27 in the wall 29 are shown in FIG. 8. These are the apertures through which the bills are dispensed from each dispensing module, into the elevator assembly. A fixed pin 206 is positioned above each aperture 27, to be received in an aperture located in the rear of each of the deposit modules. The position of the pin, in each case, corresponds to the position of the aperture, so that each module is correctly oriented when received in its position. An electrical connector 210 is also positioned in the wall 29 for each of the dispensing modules, for mating with the corresponding electrical connector in the rear wall of the corresponding dispensing module, so that power and control signals may be supplied to the dispensing module. When the correct module has been positioned in its correct location, the electrical connector 210 mates with its corresponding connector, and the aperture at the rear end of the module receives its pin 206. Because of the coding in the placement of the pins 206, a module cannot be inserted into incorrect position. In addition, the pins 206 insure correct alignment of the connector 210 with its corresponding connector, so that no power or control signals can be applied to the modules unless they are in their correct positions.

As described above, it is apparent that an automatic teller machine incorporating the present invention is small and compact, having all of the functions required for dispensing, individually, a plurality of different denominations of bills, without compromising the security or safety of the contents of the unit. Because each of the dispensing modules is self-contained, and is tamperproof, it is not necessary to have two people service the machine when the dispensing modules are to be replaced. The modules are arranged to function only when they receive power and receive appropriate command instructions through its respective connector 210, so that it is not possible to dispense bills from the dispensing units unless they are in correct position in the automatic teller machine, with the cover assembly 20 closed. Appropriate interlock means (not shown) may be employed to indicate when the cover is closed, to enable the dispensing modules for operation.

The overall relationship of the parts of the automatic teller machine is to enclose completely the two secure areas of the machine with strong plate material whenever the cover assembly is closed, and to make unauthorized entry into the interior of the machine practically impossible within any reasonable time limits, because of the locking arrangement and the construction of the unit.

The use of the dispensing modules in side-by-side relationship, in combination with the elevator assembly which collects bills dispensed from dispensing modules at a plurality of elevations, makes an extremely compact relationship possible, and the overall size and weight of the machine is substantially reduced, without compromising its security. The placement of the receipt printer and shears adjacent the elevator assembly makes it possible for a receipt to be dispensed along with the bills, and the design of the envelope chute and photosensitive means associated therewith makes it possible to provide an envelope chute for deposits for the double stamp arrangement within an extremely small space.

The relationship of the cover assembly with the back plate assembly, with the front and side walls of the secured areas carried by the cover assembly, makes it easy to open the machine for replacement of the dispensing modules and the deposit box whenever required.

It will be appreciated that various modifications and additions may be made to the invention without departing from the essential features of novelty thereof, which are intended to be defined and secured by the appended claims.

I claim as my invention:

1. In an automatic teller machine incorporating a back plate assembly and a cover assembly and means for movably mounting said cover assembly relative to said back plate assembly, locking means for releasably locking said cover assembly in fixed relation to said back plate assembly comprising a locking bar mounted on said cover assembly, said locking bar being slidably mounted on said back plate assembly between locked and unlocked positions, resilient means for normally urging said locking bar toward its locked position, a plurality of cables operatively connected with spaced-apart locations of said locking bar for moving it toward its unlocked position when said cables are retracted, drum means for simultaneously retracting said plurality of cables, means for rotating said drum, and lock means for rendering said rotating means inaccessible unless said lock means is unlocked.

2. Apparatus according to claim 1, wherein said locking bars are elongate in form and are mounted in a sliding relationship so that said locking bars slide in a direction transverse to their elongate dimension, and wherein said plurality of cables are operatively associated with opposite ends of said locking bar.

3. Apparatus according to claim 2, including a bell crank located at each end of said locking bar, each of said bell cranks having a stud cooperating with a slot in said locking bar, said locking bar being moved to its unlocked position as said bell cranks are rotated simultaneously, by virtue of said stud bearing against said notch, said cables being connected to said bell cranks for rotating said bell cranks as said cables are retracted.

4. Apparatus according to claim 3, wherein said bell cranks are positioned in relation to said locking bars such that the initial movement of said stud as said bell crank is rotated toward its unlocked position is parallel with the long dimension of said locking bar.

5. Apparatus according to claim 1, wherein said means for rotating said drum incorporates a crank and a gear train interconnected between said crank and said drum, whereby several rotations of said crank are required for a partial revolution of said drum.

6. Apparatus according to claim 1, wherein said means for rotating said drum comprises a shaft having a crank socket for receiving a crank, and wherein said lock means comprises a plug lock for rendering said crank socket inaccessible unless said plug lock is unlocked.

7. Apparatus according to claim 3, including resilient means connected to each of said bell cranks for urging them toward their locking positions.

8. Apparatus according to claim 7, wherein each said slot is long enough to allow its bell crank to rotate to an overcenter position, under the influence of said resilient means, when its respective cable is cut, to prevent unlocking rotation of said bell crank by inward movement of said locking bar.

* * * * *